US007204407B2

(12) United States Patent
Laher

(10) Patent No.: US 7,204,407 B2
(45) Date of Patent: Apr. 17, 2007

(54) DEVICE FOR THE COLLECTION OF ARTICLES, SUCH AS WASTE, DIRTY LAUNDRY, AND THE LIKE

(76) Inventor: Karl Laher, Hofstatt 23, Krems-Imbach (AT) A-3503

( * ) Notice: Subject to any disclaimer, the term of this patent is extended or adjusted under 35 U.S.C. 154(b) by 89 days.

(21) Appl. No.: 11/063,176

(22) Filed: Feb. 22, 2005

(65) Prior Publication Data

US 2006/0186187 A1 Aug. 24, 2006

(51) Int. Cl.
*A47B 81/00* (2006.01)

(52) U.S. Cl. ..... 232/1 B; 232/43.1; 232/43.2; 220/908.1; 220/909; 220/495.09

(58) Field of Classification Search ..... 232/1 B, 232/44, 43.1, 43.2; 220/908.1, 909, 495.08, 220/495.09, 523, 524, 553; D32/37
See application file for complete search history.

(56) References Cited

U.S. PATENT DOCUMENTS 3,893,615 A * 7/1975 Johnson ..... 232/43.2
4,834,262 A * 5/1989 Reed ..... 220/495.09
4,905,853 A * 3/1990 Strawder ..... 220/523
4,967,900 A * 11/1990 Gossett ..... 220/495.09
5,119,957 A * 6/1992 Joyce-Middaugh .... 220/495.09
5,174,468 A * 12/1992 Holderman ..... 220/571
5,188,254 A * 2/1993 Evans ..... 220/495.09
5,190,183 A * 3/1993 McNaughton et al. ..... 220/551
5,193,713 A * 3/1993 Greathouse et al. ..... 220/528
5,238,139 A * 8/1993 Bisceglia ..... 220/495.09
5,320,241 A * 6/1994 Evans ..... 220/495.09
6,378,721 B1 * 4/2002 Williams ..... 220/495.08
7,000,798 B2 * 2/2006 Gruennert et al. ..... 220/495.09
2005/0017010 A1 * 1/2005 Siegel et al. ..... 220/495.06

* cited by examiner

*Primary Examiner*—William L. Miller
(74) *Attorney, Agent, or Firm*—Laurence A. Greenberg; Werner H. Stemer; Ralph E. Locher

(57) ABSTRACT

A device for the collection of articles, such as waste, dirty laundry and the like, has a carrying frame with several cutouts, into which can be inserted in each case a bag-like receptacle produced from a plastic film, from a textile fabric, from paper or the like. The receptacles are fastenable to the carrying frame. The carrying frame is formed all-round, at the edgings surrounding the cutouts, with a clamping contour in the form of projecting strips, grooves, or the like, into which frame-shaped or ring-shaped, elastically deformable holding shackles assigned to the bag-like receptacles and at least virtually closed on themselves can be inserted. The upper edges of the bag-like receptacles can be clamped between the holding shackles and the clamping contour on the carrying frame.

15 Claims, 12 Drawing Sheets

DEVICE FOR THE COLLECTION OF ARTICLES, SUCH AS WASTE, DIRTY LAUNDRY, AND THE LIKE

BACKGROUND OF THE INVENTION

Field of the Invention

The present invention relates to a device for the collection of articles, such as waste, dirty laundry, and the like. The device is comprised of a carrying frame formed with a plurality of cutouts or cutouts, into which can be inserted in each case a bag-like receptacle produced from a plastic film, from a textile fabric, from paper, or the like. The receptacles are fastenable to the carrying frame.

It is known, for the collection of articles, in particular of garbage, to provide a metal or plastic container, into which there is inserted a bag-like receptacle which is produced from a plastic film, from a textile material or from paper. The articles are thereby introduced into the bag-like receptacle which, when it is filled, is then removed from the container and disposed of.

Insofar as a plurality of containers are provided next to one another, which are intended, for example, for receiving biowaste, glass, metal, plastics, and/or paper, a separation of the collected articles can thereby take place.

In prior art devices of this type, the bag-like receptacle inserted into the container is folded round outwardly with its upper edge around the upper edge of the container. There is therefore no need to fasten the bag-like receptacle to the container, since the bag-like receptacle serves, in particular, for protecting the container from being soiled by the collected waste, and the container serves for receiving or supporting the receptacle filled with articles.

SUMMARY OF THE INVENTION

It is accordingly an object of the invention to provide a device for collecting articles which overcomes the above-mentioned disadvantages of the heretofore-known devices and methods of this general type and which achieves a plurality of advantages.

On the one hand, the bag-like receptacles are to be capable of being disposed of at the same time as their contents and are to be reusable, but no carrying receptacle is to be required. For this purpose, the upper edges of the receptacles must be fastened in a carrying frame in a stable manner according to the requirements and, regardless of this, so as to be easily releasable.

On the other hand, the bag-like receptacles are to be fastened to the carrying frame in such a way that the latter is not soiled by the articles, which may be waste.

Further, it is to be possible to have the capability of filling the individual receptacles to different extents.

With the foregoing and other objects in view there is provided, in accordance with the invention, a device for collecting articles (waste, dirty laundry, etc.), comprising:

a carrying frame formed with a plurality of cutouts having surrounding edges formed with a clamping contour;

bag-type receptacles having upper edges for fastening to said carrying frame at said cutouts;

frame-shaped or ring-shaped, elastically deformable holding shackles being substantially closed on themselves and being configured for insertion into said cutouts, wherein said upper edges of said bag-like receptacles are fastened to said carrying frame by clamping between said holding shackles and said clamping contour on said carrying frame.

In other words, the above objects are achieved, according to the invention, in that the carrying frame is designed all-round, at the edgings surrounding the cutouts, with projecting strips, grooves or the like, into which frame-shaped or ring-shaped elastically deformable holding shackles assigned to the bag-like receptacles and at least virtually closed on themselves can be inserted, the upper edges of the bag-like receptacles being capable of being clamped between the holding shackles and the strips, grooves or the like provided on the carrying frame.

Preferably, the carrying frame is located within a clearance provided on the top side of a housing, in particular of a cabinet or the like, said carrying frame being capable of being lifted off from the housing or of being pivoted with respect to the latter.

According to a further preferred embodiment, a holding frame, against which the carrying frame comes to bear, is inserted into the cutout provided in the housing, in particular in the cabinet or the like. In this case, at least one part of the bars of the holding frame may be designed with an outwardly projecting web, which bears on the top side of the cabinet or the like, and with an inwardly projecting web, onto which the carrying frame comes to bear.

Further, the cutouts may be assigned at least one cover, wherein case this cover and/or the carrying frame may be pivotable on the housing. Further, the cover may be actuable by means of a hand lever or a foot lever.

Preferably, the housing is designed on one side wall with an orifice, in particular with an orifice closable by means of a door. Further, the carrying frame may be adjustable in an approximately horizontal direction with respect to the housing, for which purpose, in particular, a telescopic guide is provided. Finally, the carrying frame may be designed with upwardly projecting strips, on which a carrying shackle designed with a diametrically opposite profile can be placed, the upper edge of the bag-like receptacle being capable of being clamped between the carrying frame and the carrying shackle.

Other features which are considered as characteristic for the invention are set forth in the appended claims.

Although the invention is illustrated and described herein as embodied in a device for the collection of articles, such as waste, dirty laundry and the like, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
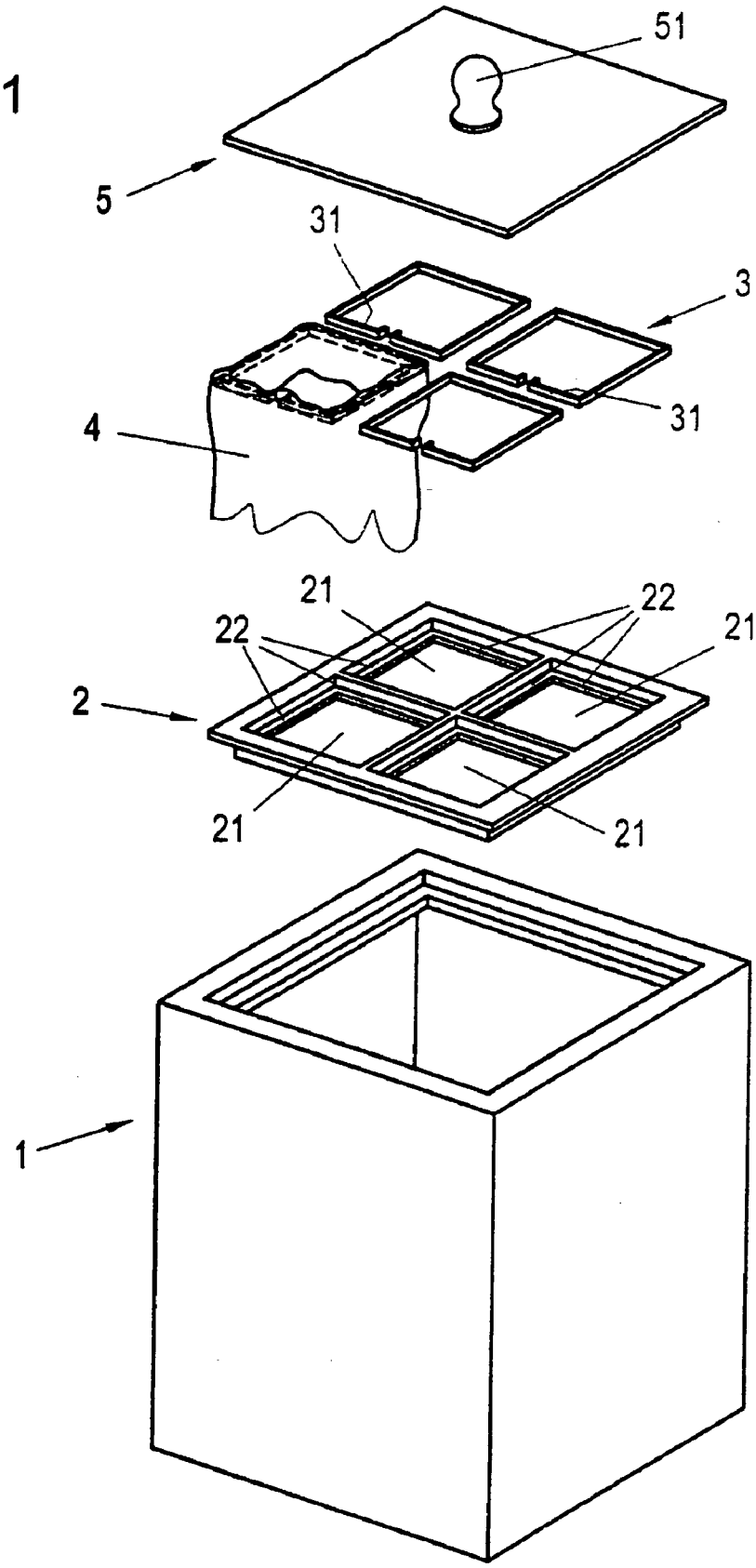
FIG. 1 shows a first device according to the invention in a diagrammatic and exploded illustration.

Referring now to the figures of the drawing in detail and first, particularly, to FIG. 1 thereof, there is shown a cabinet housing or cupboard 1, the top side of which is designed as a carrying frame 2 which can be inserted into this and which is provided with four cutouts 21, into which bag-like receptacles 4 for receiving articles can be inserted. For this purpose, the edges of the cutouts 21 are formed with a clamping contour, such as inwardly projecting strips 22. Instead of the strips 22, the inner edgings of the cutouts may be formed with grooves. The bag-like receptacles 4 are produced, for example, from a plastic film, from a textile fabric, or from paper.

The cutouts 21 of the carrying frame 2 are assigned elastically deformable holding shackles 3 which can be inserted into the cutouts 21 in such a way that they come to bear on the strips 22. The holding shackles 3 have a frame-shaped design for their deformability, one of the legs 31 being interrupted, so that the holding shackles 3 can be reduced in size as a result of elastic deformation.

The holding shackles 3 are assigned the bag-like receptacles 4 which are drawn with their upper edge over the holding shackles 3 and are turned inward.

Finally, a cover 5 is provided, which is designed with a handle 51 and by means of which the cutouts 21 can be covered. Instead of a handle, for example, a suction cup or a gripping depression may also be provided.

Figure 2:
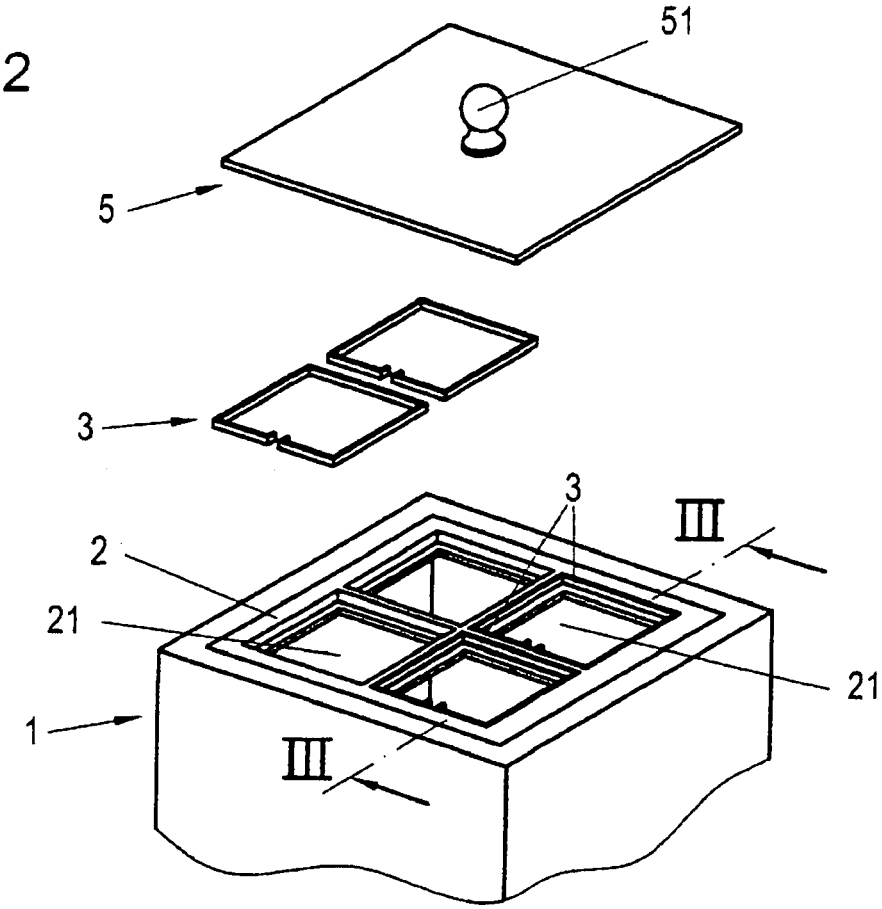
FIG. 2 shows a device according to FIG. 1 in a further perspective illustration.
Figure 3:
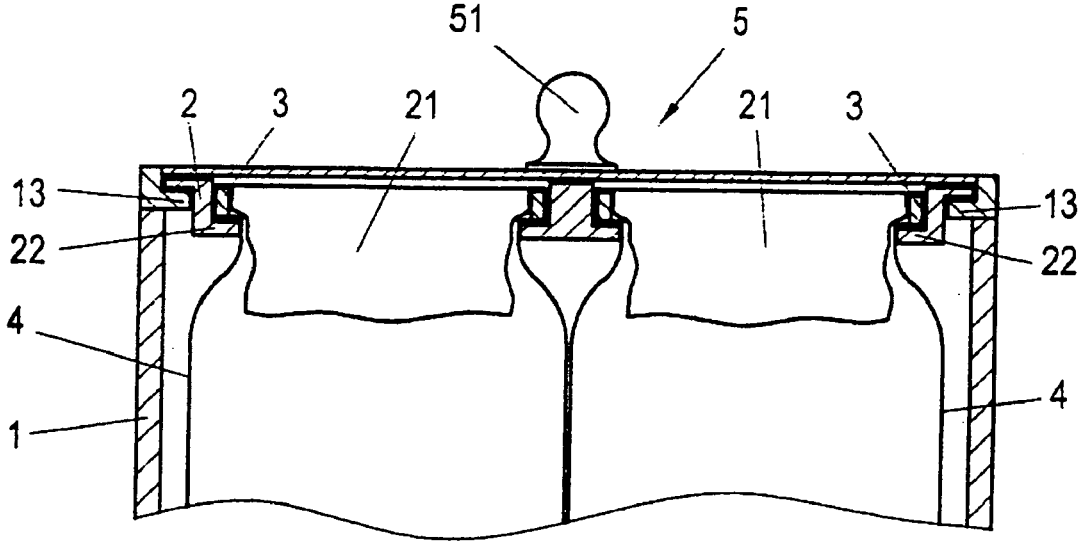
FIG. 3 is a partial sectional view of the device according to the invention taken along the line III—III of FIG. 2.

According to the illustrations of FIGS. 2 and 3, two of the holding shackles 3 are inserted into the carrying frame 2, whereas two holding shackles 3 are not yet inserted. As is further evident from FIG. 3, the carrying frame 2 lies on a strip 13 projecting inward from the inner walls of the cabinet 1.

Figure 4:
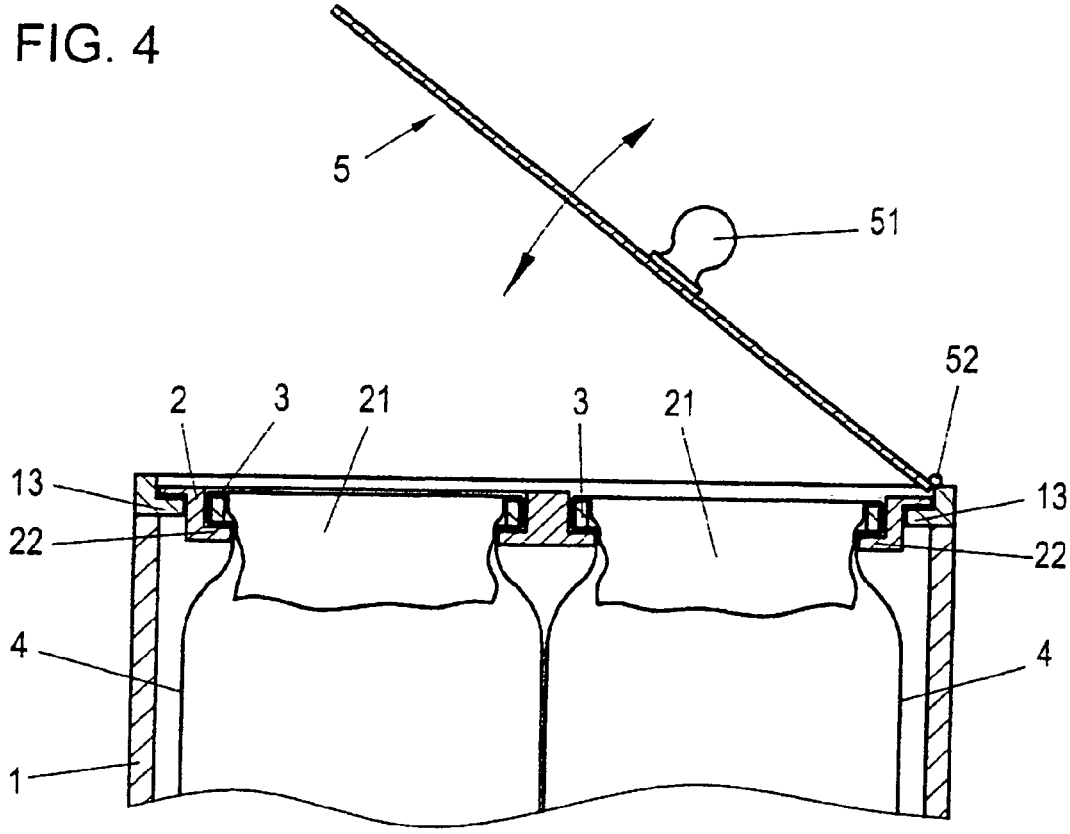
FIG. 4 is a partial, vertical section showing a variant of the device according to the invention.

With reference to FIG. 4, the cover 5 may be pivotally fastened to, or articulated at, the cabinet 1 by way of a hinge 52. The carrying frame 2 may also be fastened pivotally to the cabinet 1 by means of a hinge.

Figure 5:
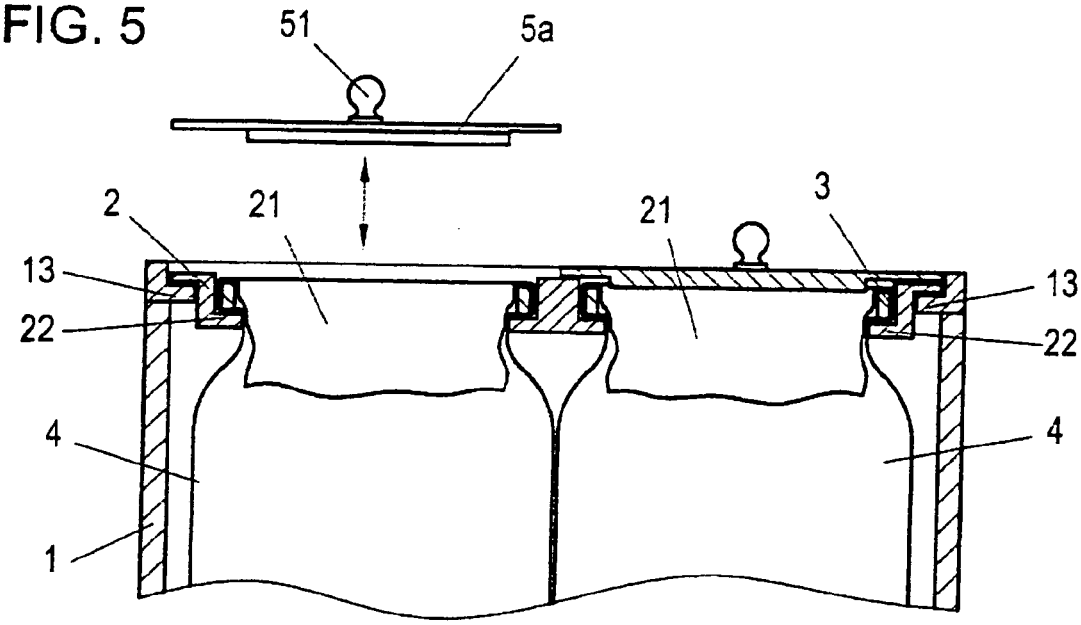
FIG. 5 is a partial, vertical section showing a further variant of the device according to the invention.

According to FIG. 5, each cutout 21 may be assigned a separate cover 5*a*.

In the embodiments of a device according to the invention which are illustrated by means of FIG. 1 to 5, the empty receptacles 4 are inserted through the perforations 21 into the cabinet 1 and their upper regions are clamped with respect to the carrying frame 2 by means of the holding shackles 3 and the strips 22 or the grooves provided in these, with the result that said receptacles are held in the carrying frame 2. They may thereupon be filled with various articles.

As soon as the filled receptacles 4 are to be removed so that the articles contained in these can be disposed of, the holding shackles 3 are released from the strips 22 or grooves and taken off. The carrying frame 2 can thereupon be lifted off or pivoted up, with the result that the filled receptacles 4 can be lifted out of the cabinet 1. Empty receptacles 4 can subsequently be inserted into the cabinet 1 again.

Figure 6:
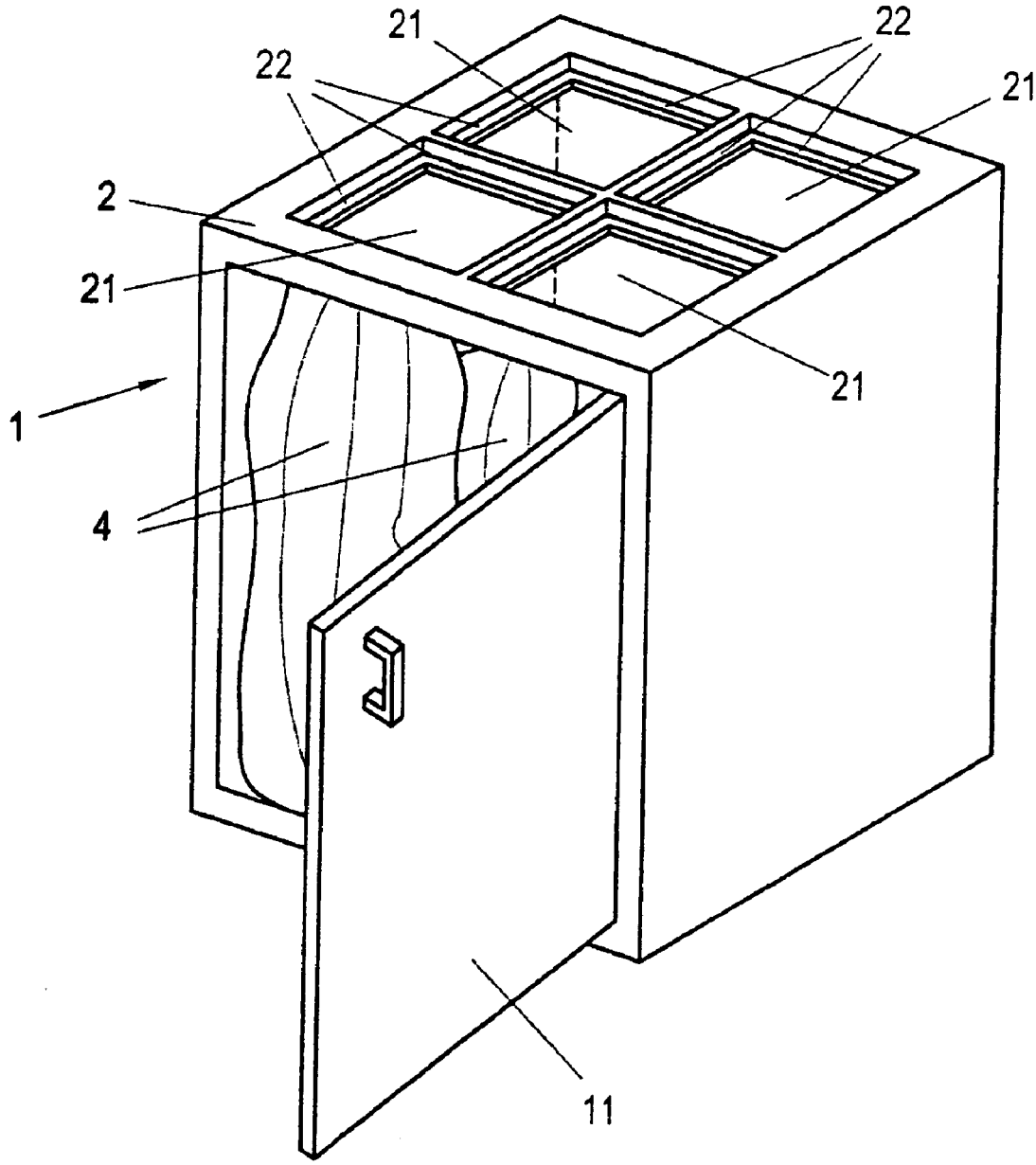
FIG. 6 shows a second embodiment of a device according to the invention in an axonometric illustration.

As illustrated further in FIG. 6, the cabinet 1 may be designed on its front side with a door 11. In this embodiment, the filled receptacles 4 do not need to be lifted out of the cabinet 1 as soon as the holding shackles 3 have been removed from the carrying frame 2, but, instead, they can be taken out of the cabinet 1 laterally.

Figure 7:
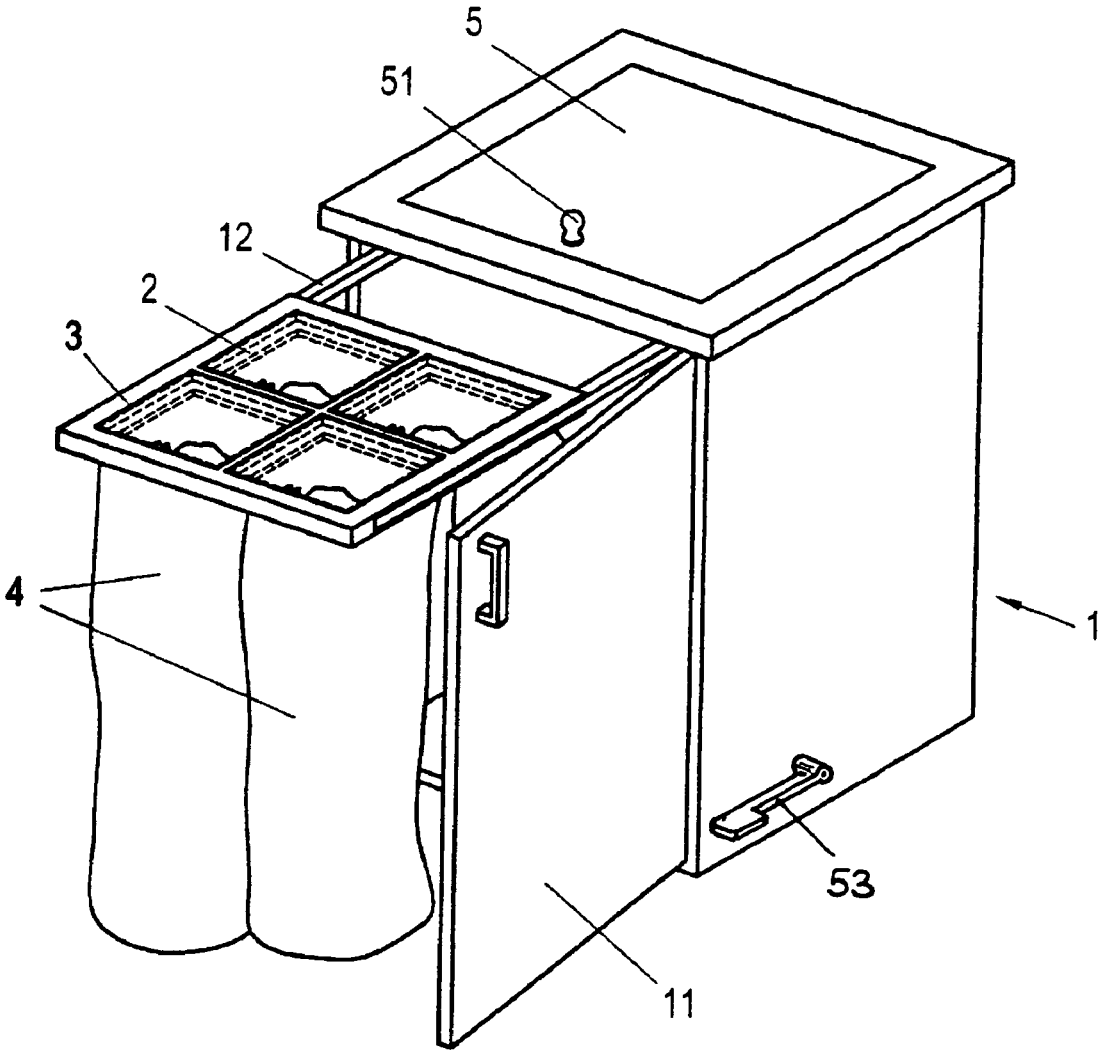
FIG. 7 shows a third embodiment of a device according to the invention in an axonometric illustration.

In the embodiment according to FIG. 7, the carrying frame 2 can be moved out of the cabinet 1 laterally by means of a telescopic guide 12, wherein the filled receptacles 4 can then be removed as soon as the holding shackles 3 have been lifted off from the carrying frame 2. There is also shown a foot lever 53 or hand lever 53 for actuating the lid 5. The lid 5 may be pivoted into the open position when the foot or hand lever 53 is actuated.

Figure 8:
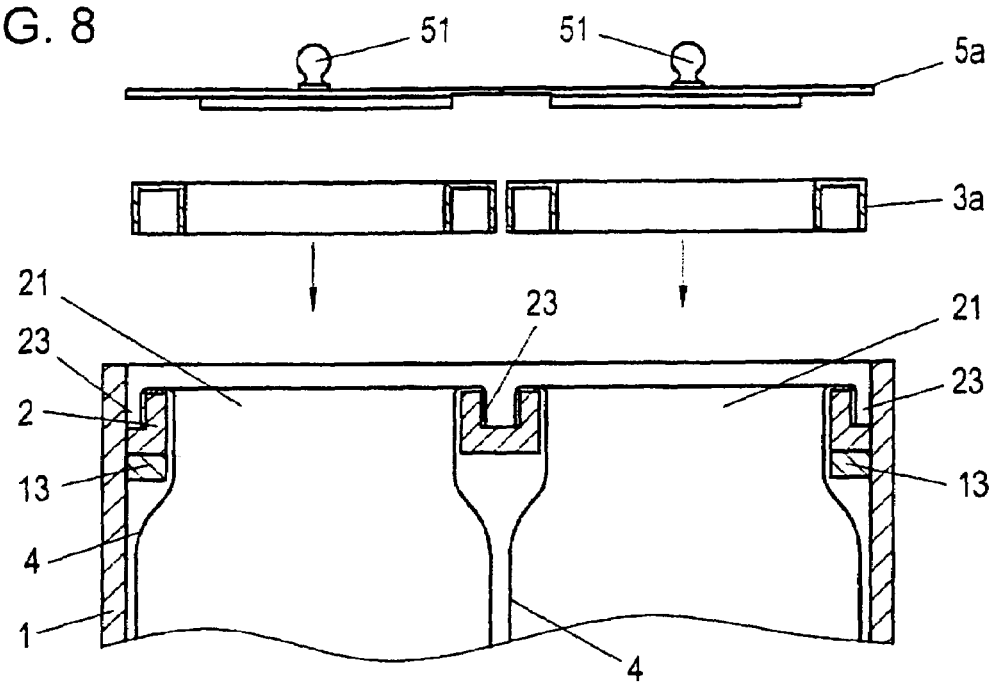
FIG. 8 shows a fourth embodiment of a device according to the invention in vertical section and in a partially truncated illustration.

In the embodiment according to FIG. 8, the carrying frame 2 is designed with upwardly open grooves 23 which are assigned U-profiled holding shackles 3*a*. As soon as the empty receptacles 4 have been inserted into the cutouts 21, their upper edges are introduced into the grooves 23 and are fastened to the carrying frame 2 by means of the holding shackles 3*a* which are placed on them. As soon as the filled receptacles 4 are to be extracted from the cabinet 1, the holding shackles 3*a* are removed and the carrying frame 2 is lifted off upward or pivoted up. In this case, too, the orifices 21 are assigned covers 5*a*.

Figure 9:
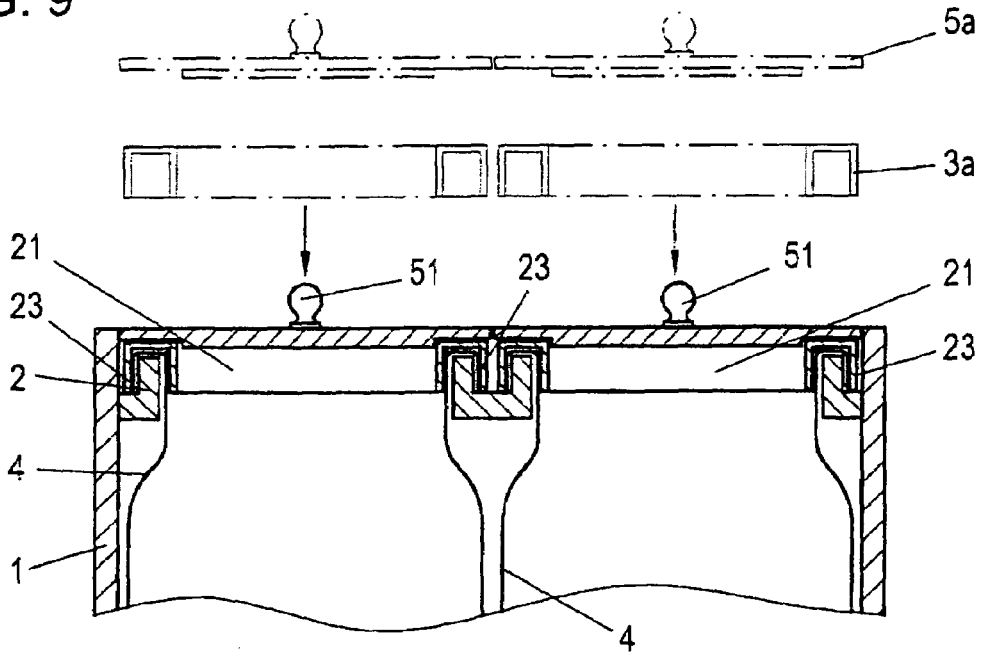
FIG. 9 shows a fifth embodiment of a device according to the invention, likewise in vertical section and in a partially truncated illustration.

The embodiment according to FIG. 9 differs from the embodiment according to FIG. 8 in that the carrying frame 2 is fastened to the cabinet 1. So that in this case the filled receptacles 4 can be extracted more easily, the cabinet 1 may be designed with a lateral door.

It is additionally pointed out that the cutouts 21 may also be delimited in round or oval form, the holding shackles 3 having a corresponding shape. It is in this case critical, in any event, that the holding shackles 3 be elastically deformable, so that they can be inserted into the cutouts 21, at the same time coming to bear on the strips 22. In this case, the bag-like receptacles 4 are clamped between the holding shackles 3 and the cutouts 21, as a result of which these receptacles are held in position even when they are partially or completely filled with articles.

Insofar as the carrying frame 2 is accessible only from above, the filled bag-like receptacles 4 are lifted out of the cabinet 1 upward. However, insofar as the carrying frame 2 is also accessible on its underside, the bag-like receptacles 4 may be drawn off downward as soon as the holding shackles 3*a* have been released. A telescopic guide 12 according to the embodiment illustrated in FIG. 7, by means of which the bag-like receptacles 4 can be displaced laterally with respect to the carrying frame 2, makes it particularly easy to remove the filled bag-like receptacles 4.

The cabinet 1 may also be designed with a roller blind or with a sliding door instead of a lateral cabinet door. Instead of the cabinet, the carrying frame may also be provided on a fold-in carrying stand.

A device of this type can be used, in particular, for the collection of garbage which is separated according to its material properties. It is also suitable, however, for the collection of other articles, such as articles of clothing.

Figure 10:
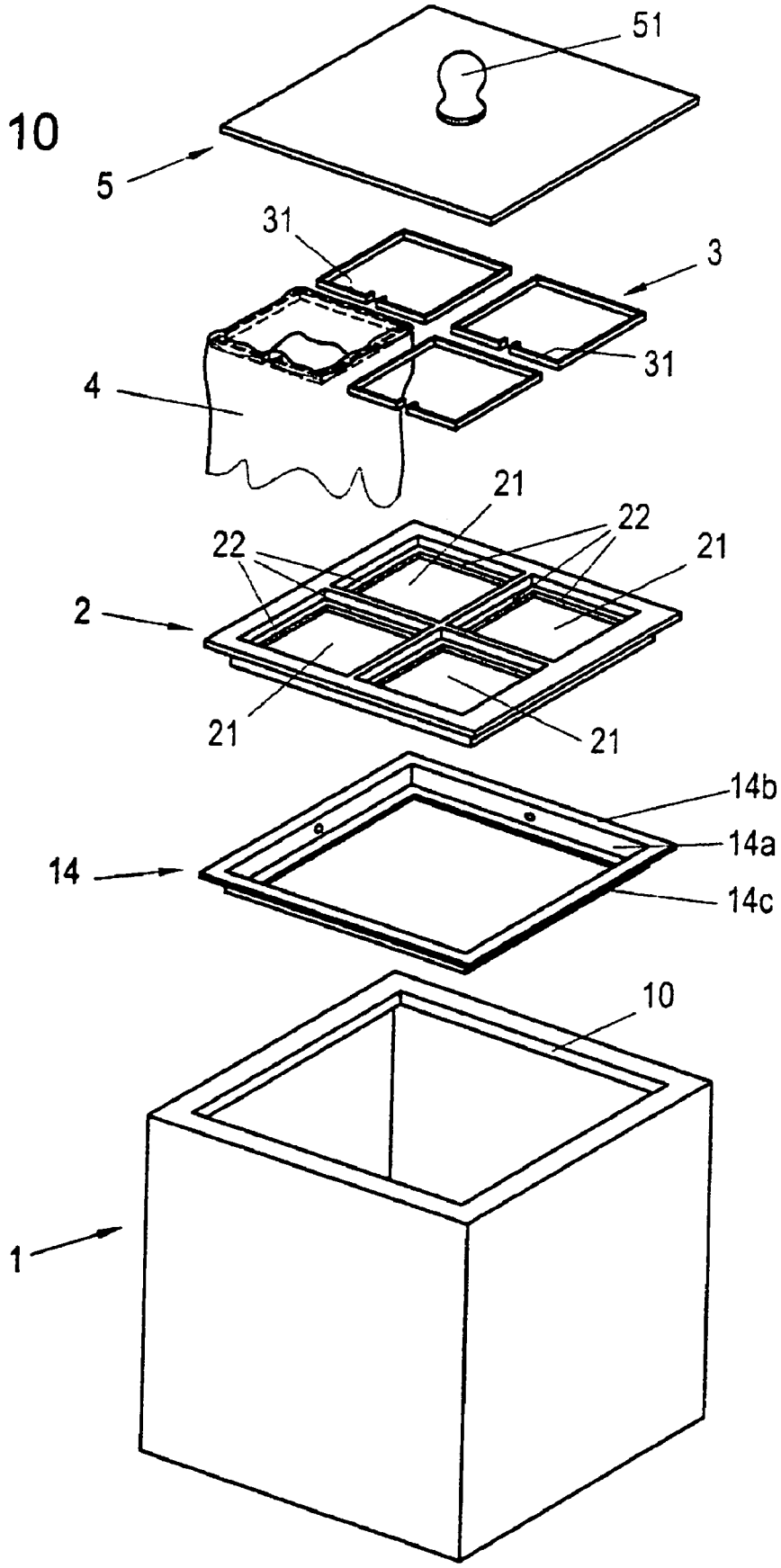
FIGS. 10, 11, and 12 are views corresponding to FIGS. 1, 2, and 3, respectively, of an embodiment of the invention with an additional holding frame.
Figure 11:
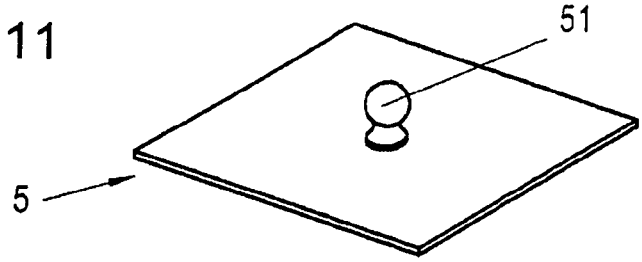
Figure 12A:
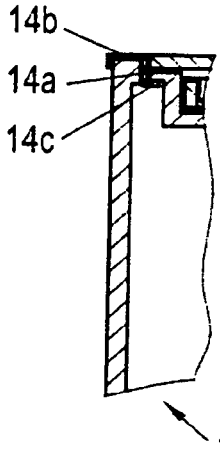
FIG. 12A is a section of an enlarged detail of FIG. 12.
Figure 12A:
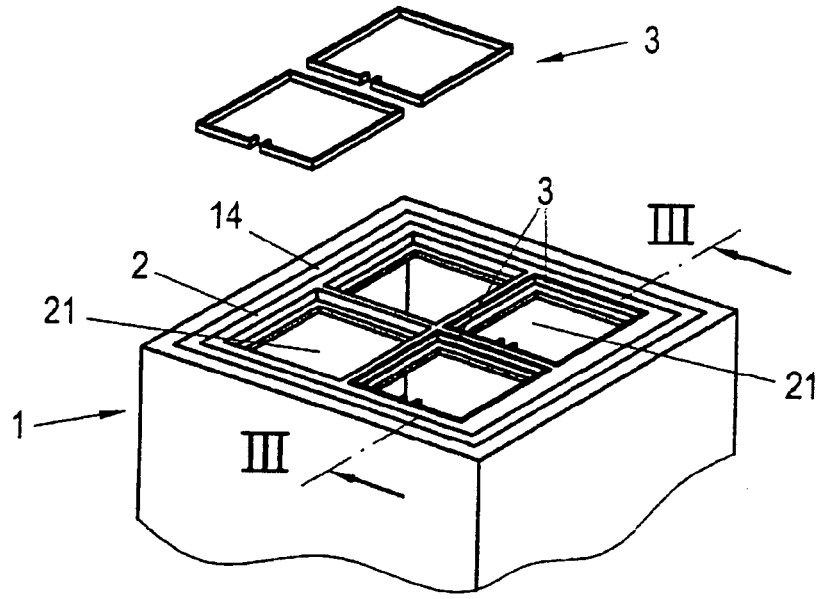
Figure 12:
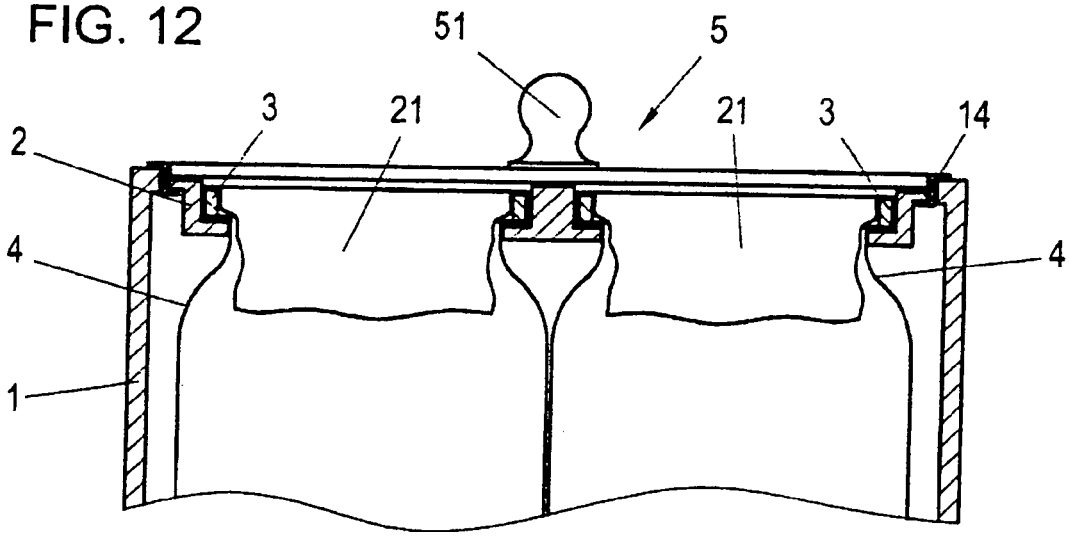
Figure 13:
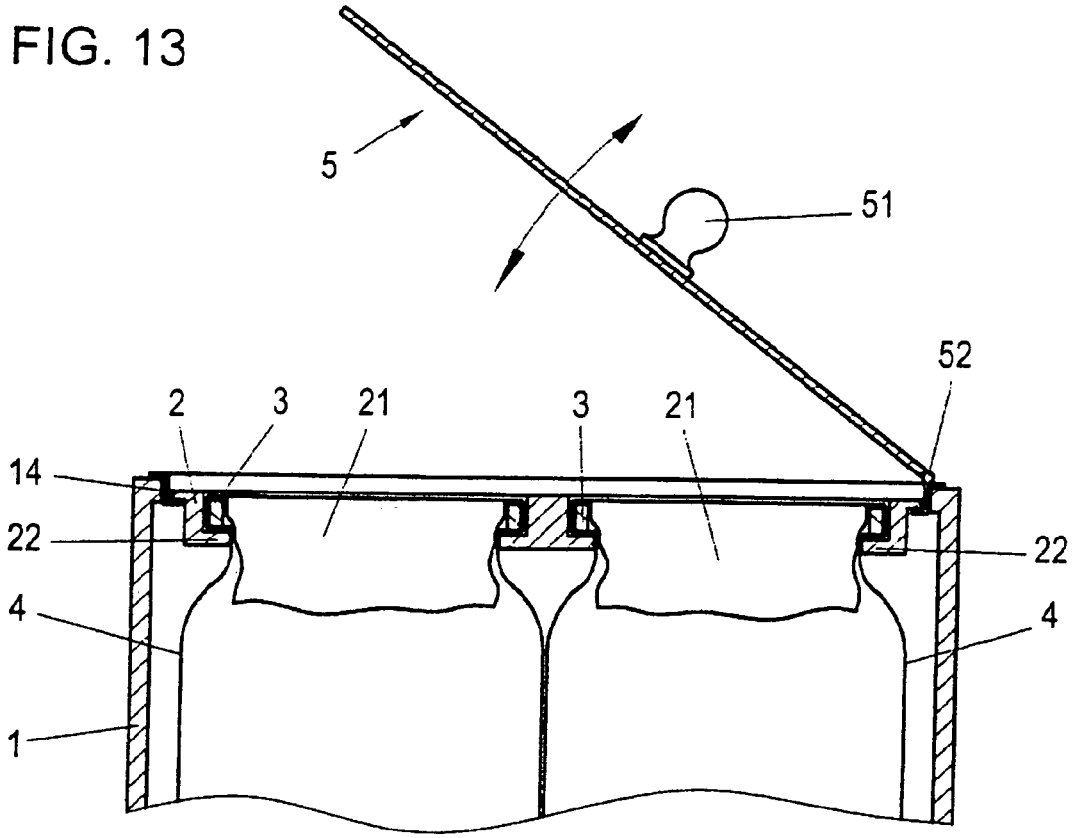
FIGS. 13–19 are views corresponding to FIGS. 4–6, 8, and 9, of the embodiment of the invention with the additional holding frame.
Figure 14:
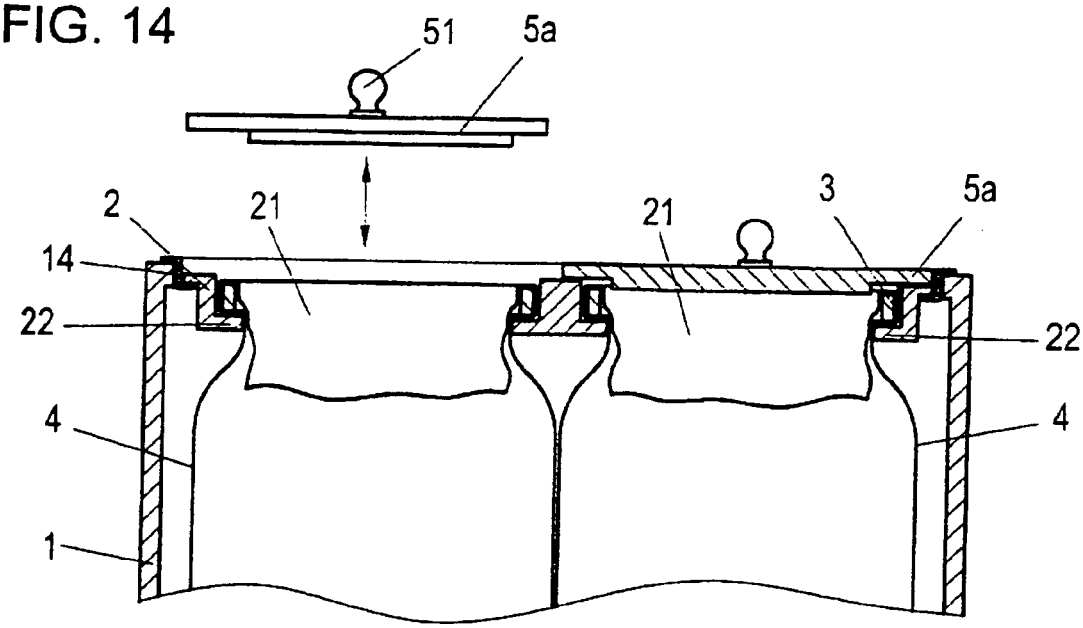
Figure 15:
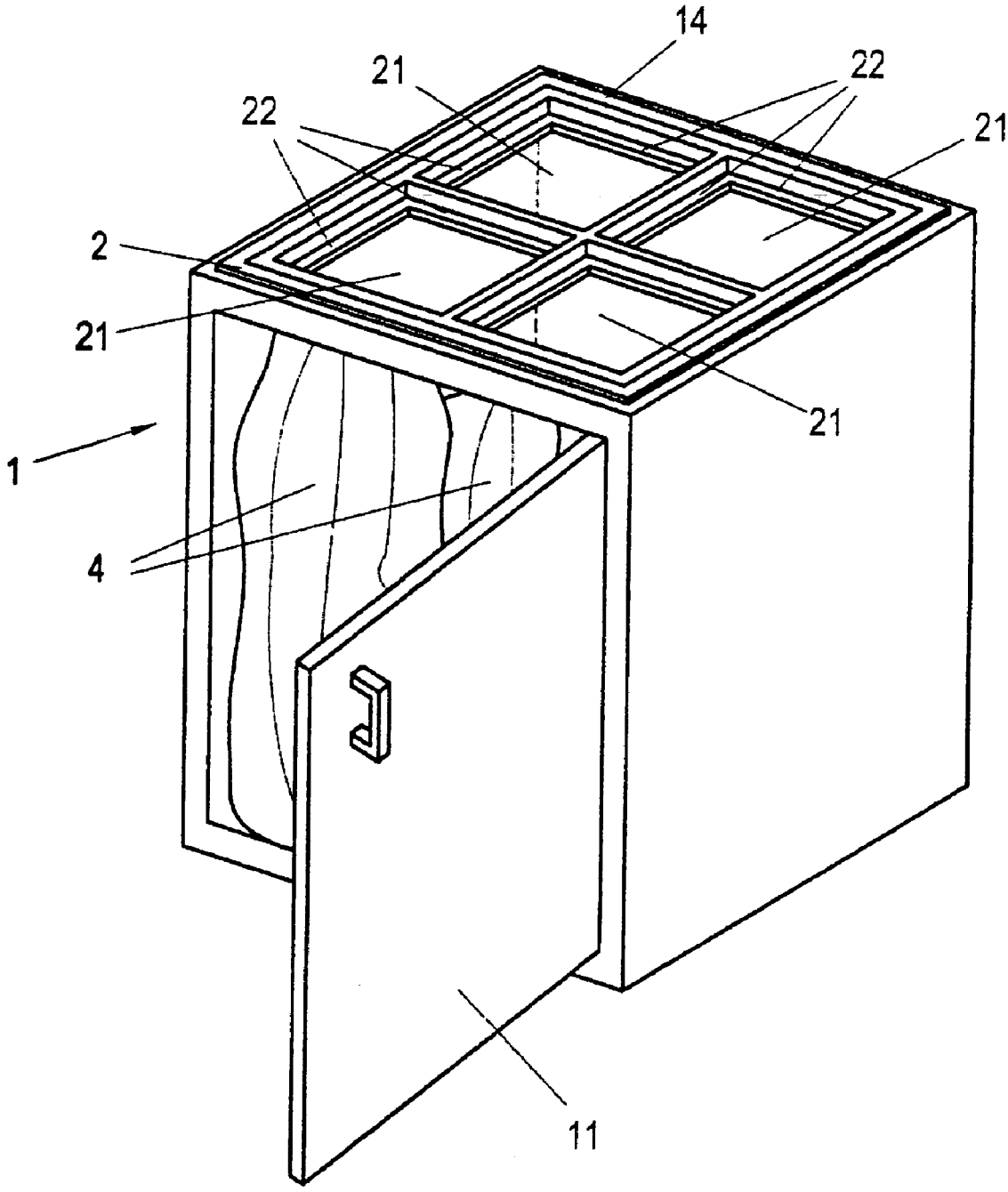

As illustrated in FIG. 10, there is also the possibility of providing, for fastening the carrying frame 2 to the cabinet 1, an additional holding frame 14, the side bars of which have in cross section a vertical web 14*a* and two horizontal webs 14*b* and 14*c* from the latter. In this case, the upper horizontal web 14*b* comes to bear on the top side of the cabinet 1, the vertical web 14*a* runs parallel to the edging 10 of the cabinet 1, and the lower horizontal web 14*c* projects inward from the holding frame 14. The carrying frame 2 comes to bear on the web 14*c*.

The particular advantage of this design is that the upper orifice of the cabinet 1 does not need to be designed with any strips or grooves which are complicated to produce. Instead, in an available piece of furniture, only one orifice which has the unprofiled edging 10 is to be produced. The additional holding frame 14, which is prefabricated as an integral part of the entire device, serves for supporting the carrying frame 2 for the bag-like receptacles 4.

FIG. 11 to 16 show the embodiments according to FIG. 2 to 6 and 8, a holding frame 14 being additionally provided in each case. By means of such an additional holding frame 14, a cabinet 1 or the like can be designed in a simple way with a device according to the invention at a later date, in that the cover plate of the cabinet 1 has produced in it a cutout, into which a device according to the invention designed with a holding frame 14 is inserted.

Figure 16:
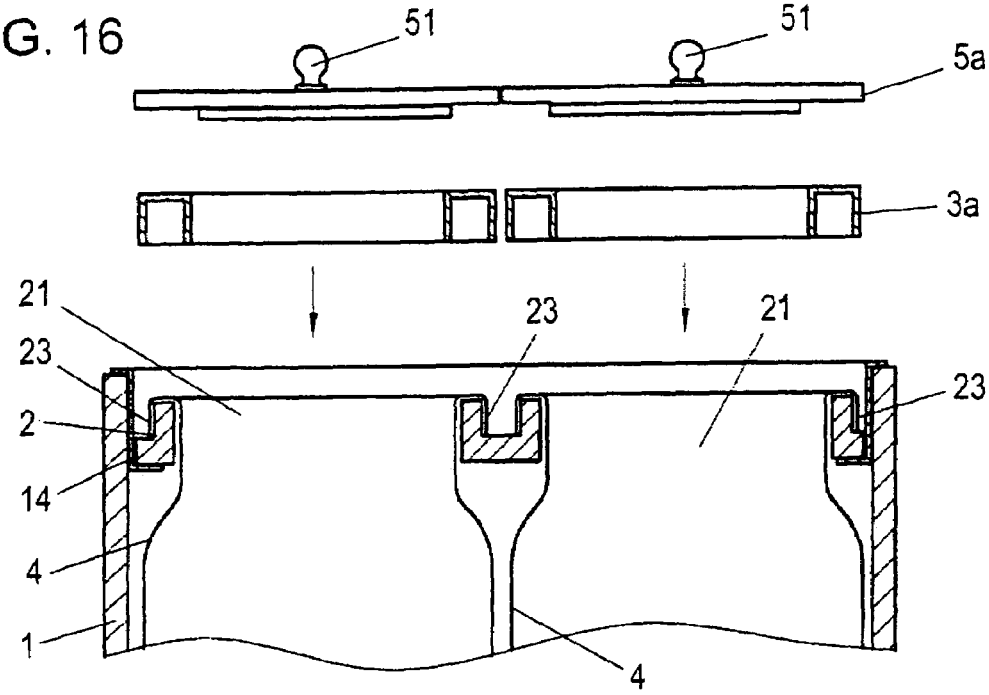
Figure 17:
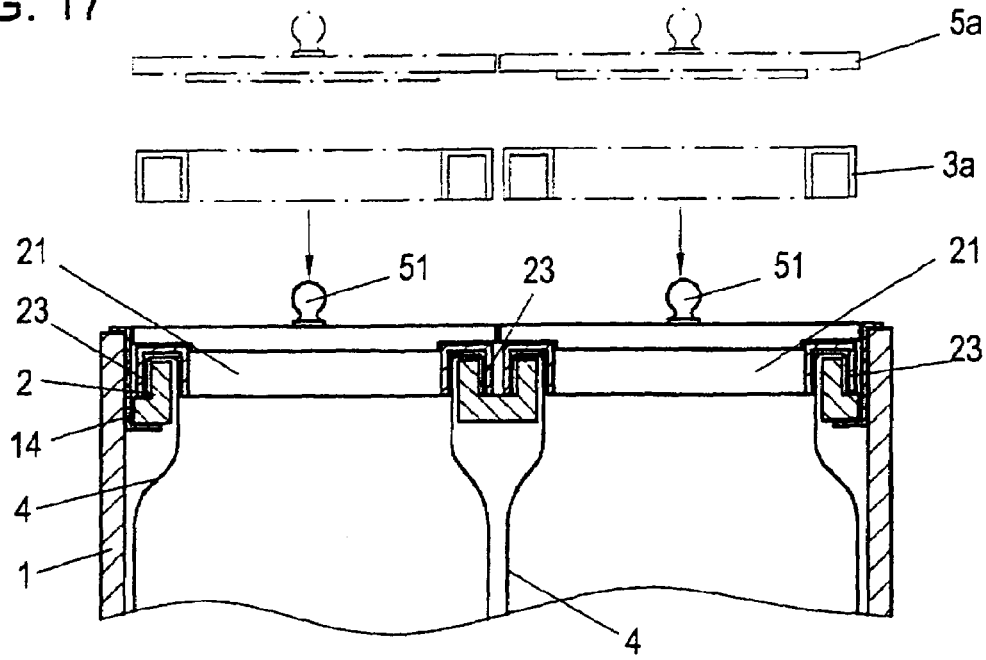
Figure 18:
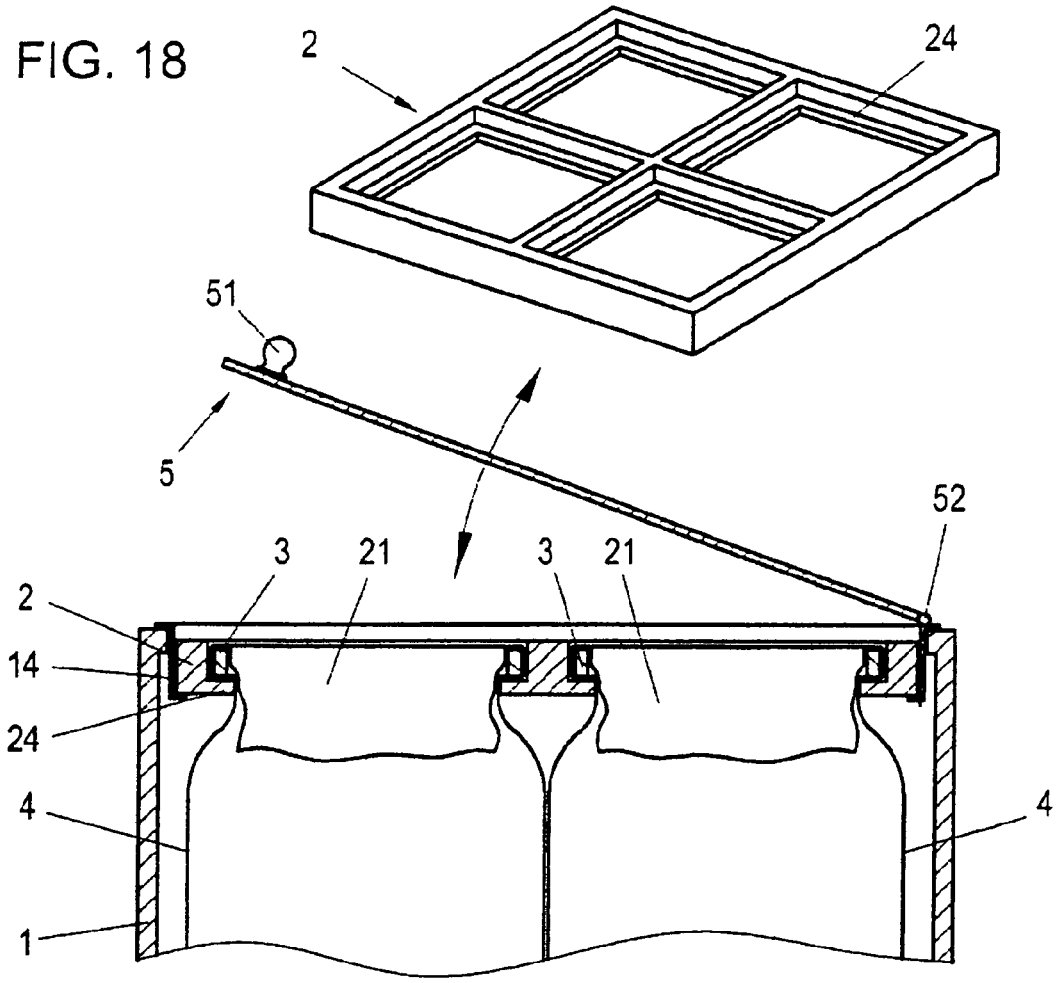
Figure 19:
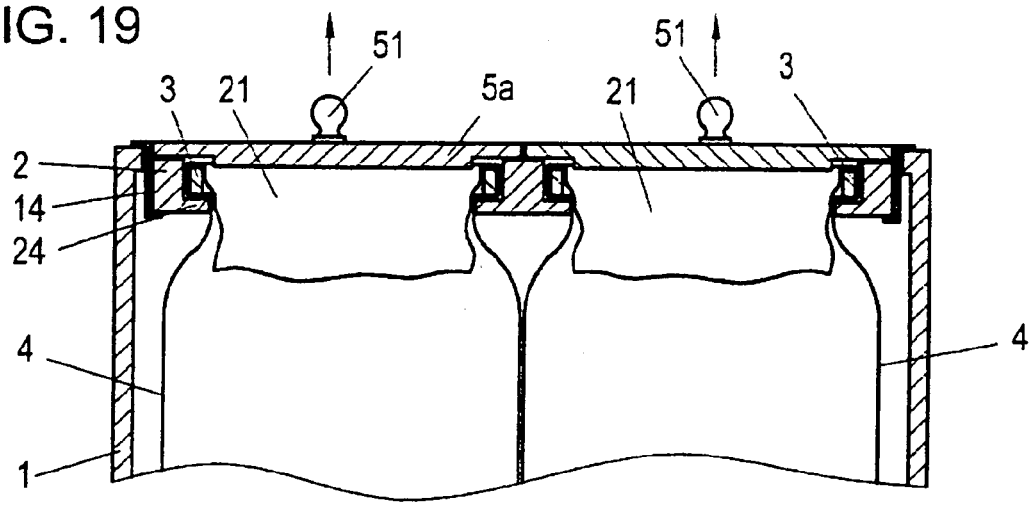

FIGS. 18 and 19 illustrate a variant of the embodiment according to FIGS. 16 and 17, according to which the carrying frame 2 is designed with an inwardly projecting carrying strip 24, on which the holding shackles 3 come to bear.

It is additionally pointed out that the covers 5 and 5*a* may be designed at their edges with a sealing strip.

I claim:

1. A device for collecting articles, comprising:

a carrying frame formed with a plurality of cutouts having surrounding edges formed with a clamping contour;

bag receptacles having upper edges for fastening to said carrying frame at said cutouts;

frame-shaped or ring-shaped, elastically deformable holding shackles being substantially closed on themselves and being configured for insertion into said cutouts, wherein said upper edges of said bag receptacles are fastened to said carrying frame by clamping between said holding shackles and said clamping contour on said carrying frame.

2. The device according to claim 1, wherein said receptacles are formed of a material selected from the group consisting of plastic film, textile fabric, and paper.

3. The device according to claim 1, wherein said clamping contour comprises at least one of projecting strips and grooves formed peripherally about said cutouts.

4. The device according to claim 1, which comprises a housing having a top formed with a clearance having said carrying frame disposed therewithin, wherein said carrying frame is disposed to be lifted off from said housing.

5. The device according to claim 4, wherein said housing is a cabinet or a cupboard.

6. The device according to claim 4, which comprises a holding frame inserted into said clearance in said housing, said carrying frame coming to bear against said holding frame.

7. The device according to claim 6, wherein said holding frame is formed with bars, and at least one part of said bars has an outwardly projecting web, bearing against a top side of said housing, and an inwardly projecting web, onto which said carrying frame comes to bear.

8. The device according to claim 4, wherein said housing has a side wall formed with an orifice.

9. The device according to claim 8, which comprises a door disposed for selectively closing said orifice.

10. The device according to claim 8, wherein said carrying frame is movably disposed relative to said housing, in a substantially horizontal direction.

11. The device according to claim 10, which comprises a telescopic drawer guide disposed to enable said carrying frame to be displaced relative to said housing.

12. The device according to claim 1, which comprises at least one cover associated with said cutouts.

13. The device according to claim 12, wherein said at least one cover is pivotally mounted to a housing.

14. The device according to claim 13, which comprises a hand lever or a foot lever for actuating said cover.

15. The device according to claim 1, wherein said holding shackles are formed as a carrying shackle and said carrying frame is formed with upwardly projecting strips, for placement thereon of said carrying shackle formed with a complementary profile, and wherein an upper edge of said receptacle is clampable between said carrying frame and said carrying shackle.

* * * * *